US005647695A

United States Patent [19]

Hilfiker et al.

[11] Patent Number: 5,647,695

[45] Date of Patent: Jul. 15, 1997

[54] SOIL FILLED WALL

[75] Inventors: Harold K. Hilfiker; William B. Hilfiker, both of Eureka, Calif.

[73] Assignee: Hilfiker Pipe Company, Eureka, Calif.

[21] Appl. No.: 420,362

[22] Filed: Apr. 11, 1995

[51] Int. Cl.[6] ..... E02D 29/02

[52] U.S. Cl. ..... 405/284; 405/258; 405/287; 47/82

[58] Field of Search ..... 405/284, 285, 405/286, 262, 258; 47/82, 83

[56] References Cited

U.S. PATENT DOCUMENTS

| | | | |
|---|---|---|---|
| 2,113,523 | 4/1938 | White | 47/83 X |
| 2,193,425 | 3/1940 | Lake | 47/33 |
| 4,313,278 | 2/1982 | Pointing et al. | 47/82 |
| 4,530,622 | 7/1985 | Mercer | 405/284 X |
| 4,610,568 | 9/1986 | Koerner | 405/258 X |
| 4,960,349 | 10/1990 | Willibey et al. | 405/284 X |
| 5,076,735 | 12/1991 | Hilfiker | 405/284 |
| 5,156,496 | 10/1992 | Vidal et al. | 405/284 X |
| 5,287,650 | 2/1994 | Moriguchi et al. | 47/82 |
| 5,320,455 | 6/1994 | Mattox | 405/284 |
| 5,472,297 | 12/1995 | Heselden | 405/286 |

FOREIGN PATENT DOCUMENTS

| | | | |
|---|---|---|---|
| 674209 | 10/1929 | France | 7/2 |
| 75 07114 | 11/1976 | France | E02D 17/20 |

OTHER PUBLICATIONS

B.R. Christopher and S.B. Steinberg, "The Heavy Duty Geogrid Wall," *Civil Engineering* pp. 75–77 (May 1988).

"Hilfiker Welded Wire Wall *Patent No. 4117686," Trade Publication (19 ).

"Bekaert Gabions," Terra Aqua Conservation (a Division of Bekaert Steel Wire Corporation) product disclosure, pp. 1–57 (1970).

*Primary Examiner*—Dennis L. Taylor

*Attorney, Agent, or Firm*—Limbach & Limbach L.L.P.

[57] ABSTRACT

A soil filled wall which accommodates the growing of plant life. The wall comprises welded wire structures which contain soil. In one embodiment the wall is free standing to provide a fence-like structure suitable for use as a sound barrier. In another the wall is erected at the situs of an earthen formation to retain and provide a face for the formation. In the latter embodiment, anchors secure the wall to the earthen formation.

15 Claims, 13 Drawing Sheets

SOIL FILLED WALL

BACKGROUND OF THE INVENTION

The present invention relates to a soil filled wall which may be used as a free-standing sound barrier or the face of a retention wall for earthen formation. In its more specific aspects, the invention is concerned with such a wall comprised of a pair of spaced welded wire panels defining a cavity therebetween which may be filled with soil. The invention is also concerned with a method of making such a wall.

The prior art teaches the use of gabions for retaining earthen formations and the use of welded wire or polymeric gridworks for reinforcing and retaining soil formations. Gabions are rock-filled baskets and in current technology are typically fabricated of wires twisted together. Welded wire walls are taught by U.S. Pat. Nos. 4,117,686, 4,391,557 and 4,505,621. In the case of these patents, welded wire gridworks form both soil reinforcing structure and a face structure for the wall. Rocks are disposed behind the face structure. U.S. Pat. No. 4,391,557 teaches forming concrete around the welded wire face structure. U.S. Pat. No. 4,856,939 teaches a wall comprised of a combination of a polymeric gridwork mat and a welded wire gridwork.

SUMMARY OF THE INVENTION

The wall of the present invention comprises a pair of welded wire panels disposed in spaced relationship to one another to define a soil receiving cavity therebetween. The panels are secured together and means are provided to support the panels in a generally upright condition with soil contained therebetween. In one embodiment, the wall is free-standing and the means adapted to support it comprise posts anchored in the earth and fastened to the wall structure. In another embodiment, the wall is secured to the face of an earthen formation and the means to support it comprise anchors securing the wall to the face.

A variety of structures are provided to secure the panels of the wall in spaced relationship. In some, the structures comprise separate welded wire gridworks which are secured between the panels. In others, the structures comprise portions of the panels which are bent at an angle relative thereto. In one embodiment wherein the wall is secured to the face of an earthen formation, a concrete layer is formed between the wall and the formation. The latter embodiment employs hanger ties which secure the wall in spaced relationship to the formation and accommodate the formation of the concrete layer.

In the method of the invention, a pair of welded wire panels are supported on an earthen formation in generally vertically disposed spaced relationship. The panels are secured together and the wall is formed by progressively filling the space between the panels, from bottom to top. In the method, the panels may be supported, so that the wall is either free-standing, or secured to the face of an earthen formation.

A principal object of the present invention is to provide a wall which accommodates the growth of plant life for aesthetic and anti-graffiti purposes.

Another object of the invention is to provide such a wall comprised of spaced welded wire panels which define a soil receiving cavity therebetween.

Still another object of the invention is to provide such a wall which may be free-standing or secured in place against an earthen formation as part of a retaining structure for the formation.

Still another object of the invention is to provide such a wall which may be secured to an earthen formation as part of a retaining structure for the formation and which accommodates the formation of a cement face between the wall and the formation.

Yet a further object of the invention is to provide such a wall with hanger means to facilitate its attachment to the face of an earthen formation.

Another and further object of the invention is to provide such a wall which is made up of standardized welded wire components which may be coupled together to form spaced panels.

These and other objects will become more apparent from the following detailed description and accompanying drawings.

DESCRIPTION OF THE PREFERRED EMBODIMENTS

First Embodiment Wall

As shown in Figures in 1 and 2, this embodiment is secured to the face of an earthen formation "E." Soil nails "N" secure the wall to the formation. A planting berm "B" is disposed in front of the wall and held in place by a concrete bumper 10. For purposes of illustration, a tree 12 is shown planted in the berm "B."

Figure 1:
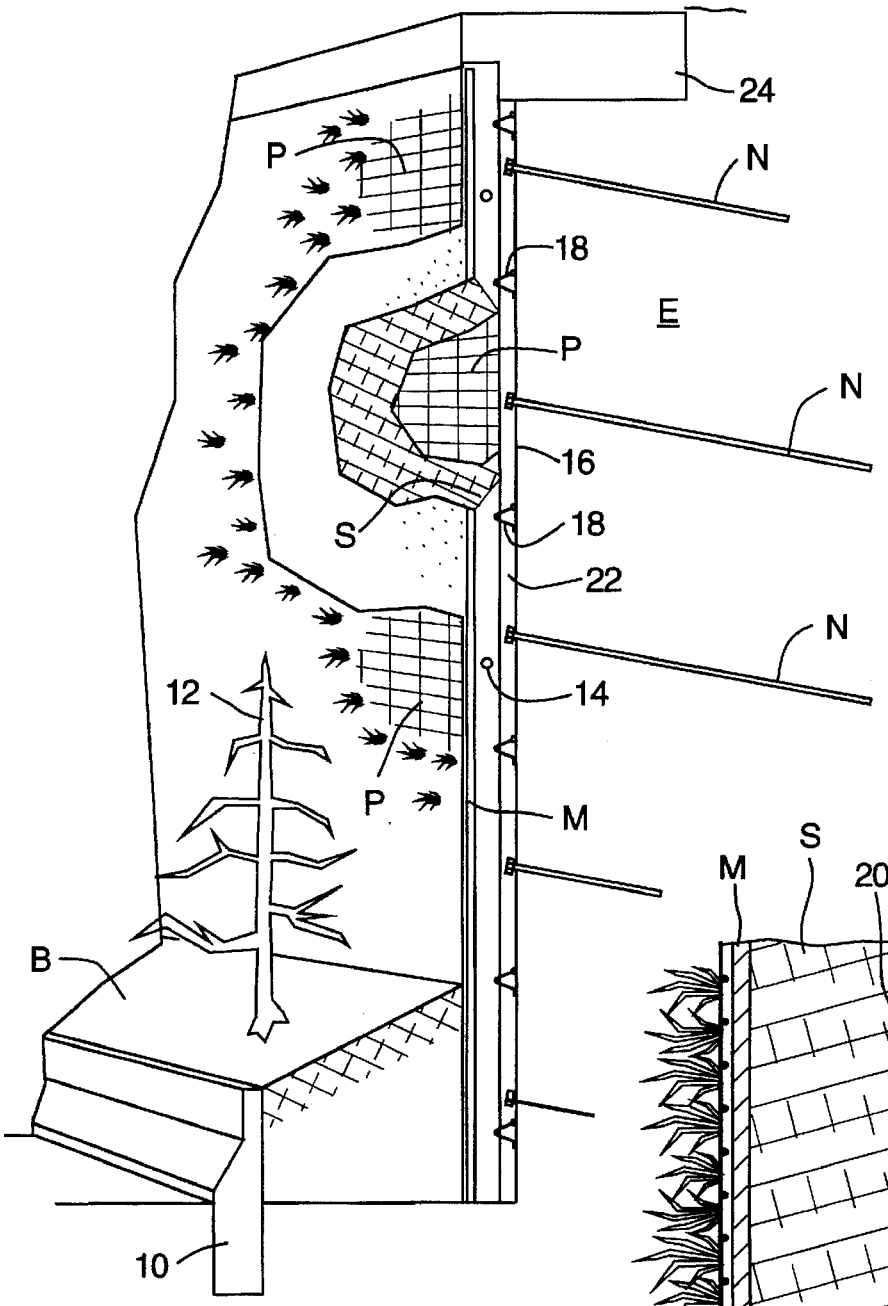
FIG. 1 is a perspective view of a first embodiment of the inventive wall wherein the wall is secured to the face of an earthen formation, with parts of the wall broken away to show the interior details.
Figure 2:
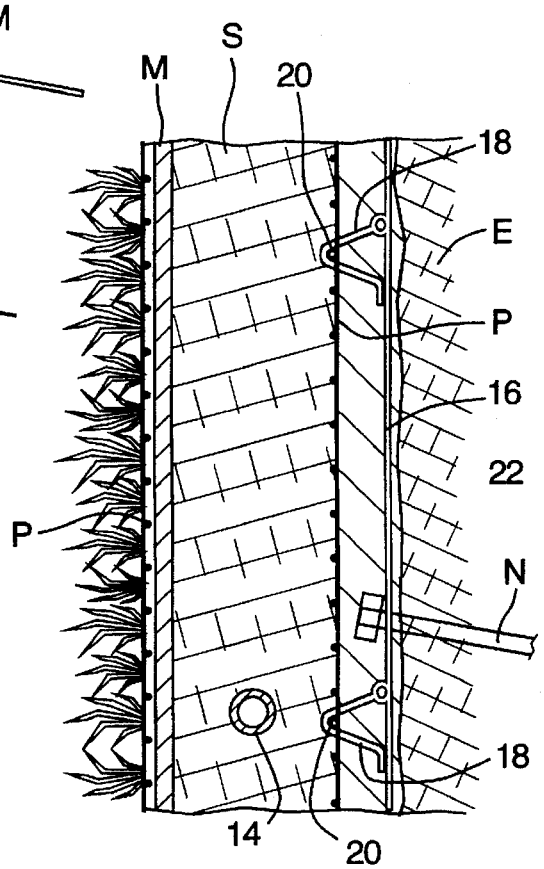
FIG. 2 is an enlarged cross-sectional elevational view taken through the first embodiment wall of FIG. 1.

The wire components making up the first embodiment wall may take the form of any of the embodiments hereinafter described wherein the wall is made up of a pair of generally vertically extending welded wire panels "P" secured together in spaced relationship. The panels "P" define a soil receiving cavity therebetween. As shown in FIGS. 1 and 2, a soil erosion mat "M" is juxtaposed to the inside of the outer panel "P" within the soil receiving cavity and soil, designated "S" is disposed within the cavity. An irrigation pipe 14 extends through the soil.

The nails "N" of the first embodiment wall engage a welded wire hanger mat 16 having hanger ties or stands 18 secured thereto and extending outwardly therefrom through the inner panel "P." Rods 20 extend through the ties 18 to the inside of the inner panel "P" to secure the panel in spaced relationship to the face of the earthen formation "E." A concrete layer 22, formed of a material such as SHOTCRETE is formed between the face of the earthen formation "E" and the innermost panel "P." The hanger mat 16 and ties 18 are imbedded within this concrete layer.

FIGS. 1 and 2 graphically depict plant life growing on the wall and extending through the outer panel "P." A curb-like barrier slab 24 is shown in FIG. 1 extending over the top of the earthen formation and into engagement with the upper end of the wall. This slab is optional and may take any desired configuration, depending upon the intended use of the earthen formation. A barrier curb (not illustrated) might be mounted on the slab 24.

Alternative Constructions for Hanging the Wall

Figure 3:
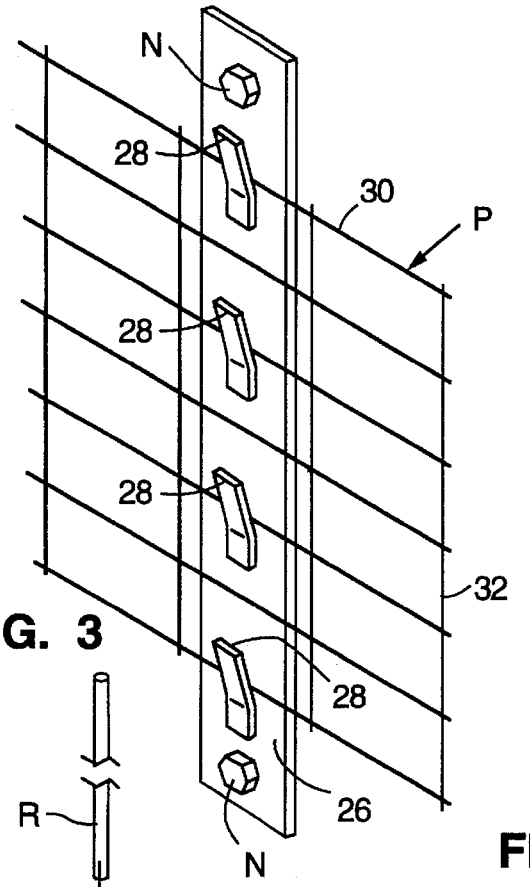
FIG. 3 is a perspective view of a first type of hanger plate which may be used to secure the inventive wall to the face of an earthen formation.
Figure 4:
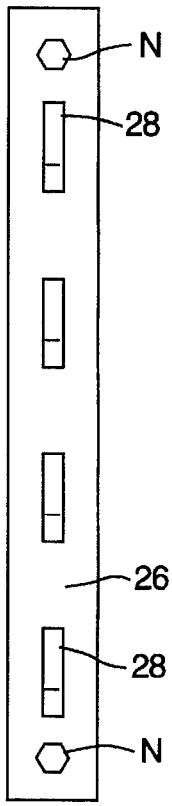
FIG. 4 is a plan elevational view of the first type of hanger plate shown in FIG. 3.
Figure 5:
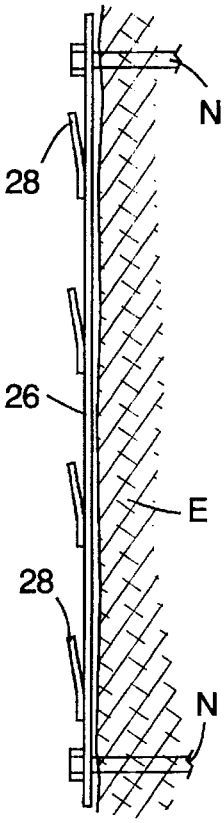
FIG. 5 is a side elevational view of the hanger plate shown in FIG. 3, as it would appear secured to the face of an earthen formation.

FIGS. 3–5 show a first type of hanger plate 26 which may be used in place of the hanger mat 16 of the first embodiment wall. Plate 26 is elongate and fashioned for vertical disposition. Apertures in the ends of the plate accommodate soil nails "N." Hooks 28 are welded to plate 26 and extend outwardly therefrom at vertically spaced intervals which match the spacing of the cross-wires of the panel "P." As shown in FIG. 3, the cross-wires are designated 30 and spaced from one another by approximately six inches. The hooks 28 are positioned to engage every other cross-wire and, accordingly, are spaced from one another by approximately twelve inches. The vertically extending wires of the mat "P" shown in FIG. 3 are spaced from one another by approximately twelve inches. The spacing of the wires may vary. In some instances where a very dense panel configuration is desired, the spacing of the cross-wires and vertical wires may be three inches by three inches. With the latter dimensions, and assuming the hooks 28 were to engage only every other cross-wire, the hooks would be spaced by six inches.

The hooks 28 are welded to the hanger plate 26 and extend outwardly therefrom on the side opposite that engaged with the earthen formation "E" (see FIG. 5). From FIG. 5, it will be seen that the plate 26 is secured directly against the earthen formation "E" by the nails "N." As there shown, it will also be appreciated that the innermost panel "P" of the wall would be secured directly against the plate 26 by the hooks 28 and that there would be no appreciable distance between that panel and the earthen formation. Accordingly, the hanger plate 26 is not intended to accommodate the formation of a concrete layer, such as the layer 22 of FIG. 2, between the earthen formation and the wall.

Figure 6:
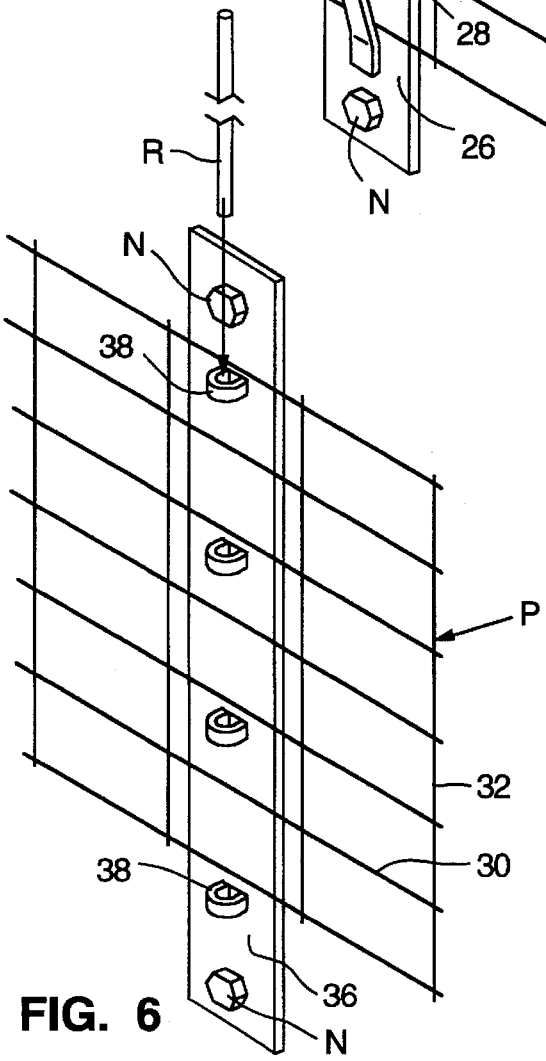
FIG. 6 is a perspective view of a second type of hanger plate which may be used to secure the inventive wall to the face of an earthen formation.
Figure 7:
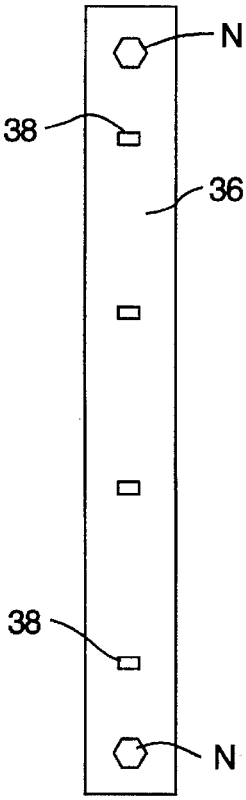
FIG. 7 is a plan elevational view of the second type of hanger plate shown in FIG. 6.
Figure 8:
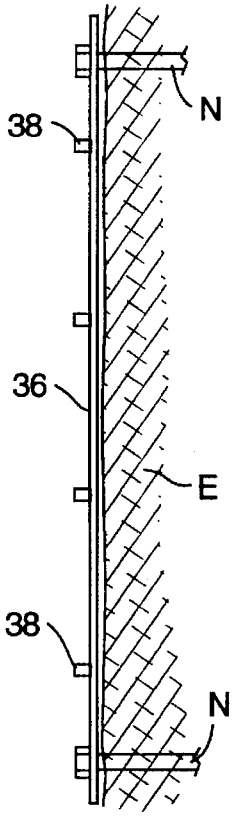
FIG. 8 is a side elevational view of the hanger plate of FIG. 6, as it would appear when secured to the face of an earthen formation.

FIGS. 6–8 show a second type of hanger plate, designated 36. Like the hanger plate 26, the plate 36 is elongate and designed for vertical disposition and securement to the face of an earthen formation through nails "N" extending through apertures (not illustrated) formed in the plate. Rather than hooks, however, the plate 36 is formed with loops fixed thereto and extending outwardly therefrom at vertically spaced intervals approximately twice the spacing between the cross-wires 30 of a panel "P" hung on the plate. The loops 38 may be punched from the material of the plate 36, or integrally welded thereto. A rod "R" is extensible through the loops 38 to the outside of a panel "P" secured thereto to hold the panel to the plate. The arrow line beneath the rod "R" in FIG. 6 depicts the manner in which the rod is extended through the loops.

FIG. 8 shows the manner in which the plate 36 is secured to an earthen formation by nails "N." As there seen, it would be appreciated that the panel "P" of a wall secured to the plate would be disposed essentially against the surface of the earthen formation. Accordingly, like the plate 26, the plate 36 is not intended to accommodate the formation of a layer of concrete between the earthen formation and the wall secured thereto.

Second Embodiment Wall

Figure 9:
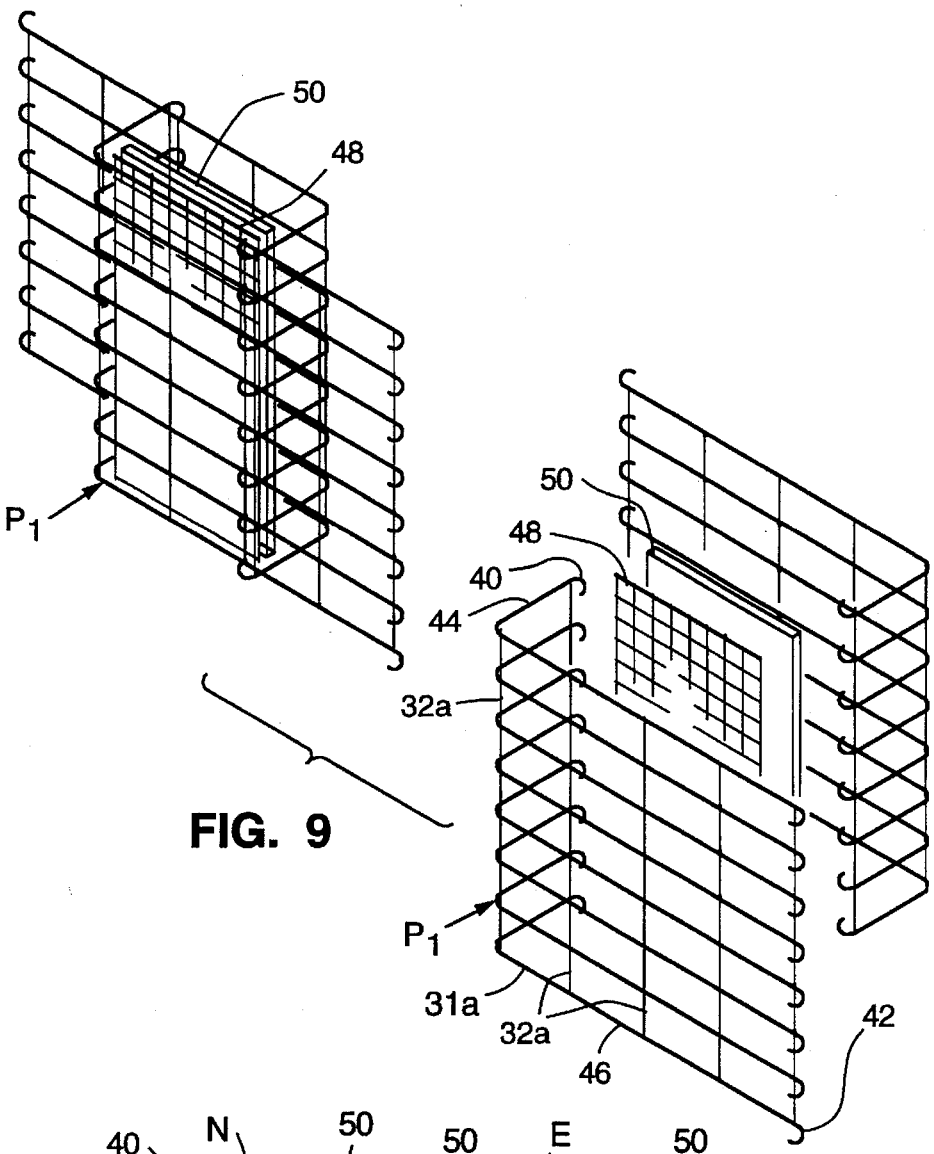
FIG. 9 is a perspective view of a second embodiment of the inventive wall, with the right hand part thereof exploded to illustrate the components of the wall.
Figure 10:
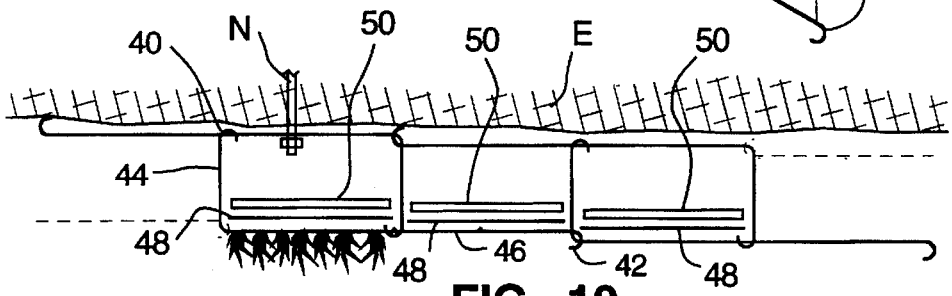
FIG. 10 is a top plan view of the second embodiment wall of FIG. 9, as the wall would appear when secured to the face of an earthen formation.
Figure 11:
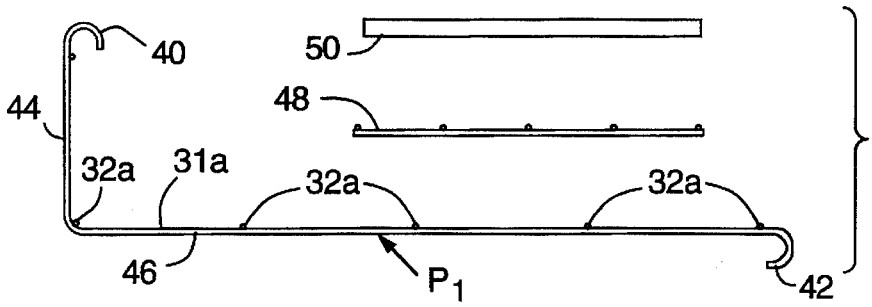
FIG. 11 is an exploded top plan view of a portion of the second embodiment wall, illustrating the components which are repeated in the construction of the wall.

As shown in FIGS. 9–11, this wall is comprised of welded wire panels "$P_1$" of a generally L-shaped configuration. The cross-wires of the panels "$P_1$" are designated 31*a* and spaced by approximately six inches. The vertically extending wires of the panels are designated by the numeral 32*a* and spaced by approximately twelve inches. Wires 31*a* are bent back upon the panel "$P_1$" to form hooks 40 and 42. When assembled, as shown in FIG. 10, successive panels "$P_1$" are disposed in oppositely extending orientation with the hooks 40 of one panel engaged around an intermediate wire 32*a* of a first adjacent panel and the hooks 42 extending around a wire 32*a* at the intersection formed between the angularly disposed segments of a second adjacent panel. The panels each have a short transversely extending segment, designated 44, and a longer longitudinally extending segment, designated 46. When assembled, the transversely extending segments 44 form spanning welded wire gridworks between the inner and outer panels making up the wall.

In the assembled condition seen in FIG. 10, the second embodiment wall is secured to an earthen formation "E" by nails "N." Although not there shown, the nails may be engaged with the wall through hangers such as those of FIGS. 3 or 6. Welded wire backing mats 48 are disposed immediately interior of the outer longitudinally extending segments of the wall and soil erosion mats 50 are disposed to the interior of the backing mats. With panels "$P_1$" having six inch by twelve inch spacing for the wires, the backing mats would typically have wires spaced three inches by three inches. As the wall is erected, soil would be filled into the cavity between the inner and outer panels formed by the longitudinal segments 46. This functions to hold the mats 48 and 50 in place, as shown in FIG. 10. FIG. 10 also graphically depicts plant life growing through the outer surface of the wall.

Third Embodiment Wall

Figure 12:
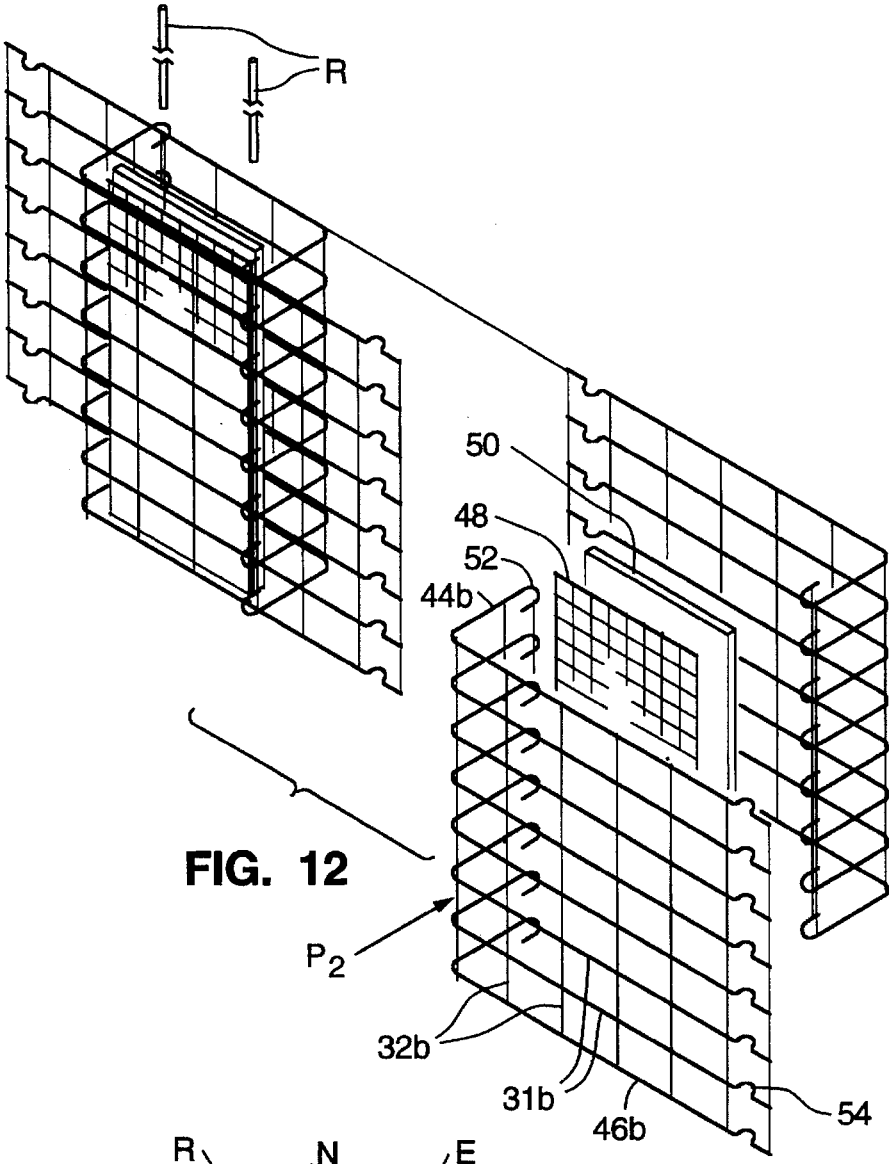
FIG. 12 is perspective view of a third embodiment of the inventive wall, with the right hand part thereof exploded to illustrate the components of the wall.
Figure 13:
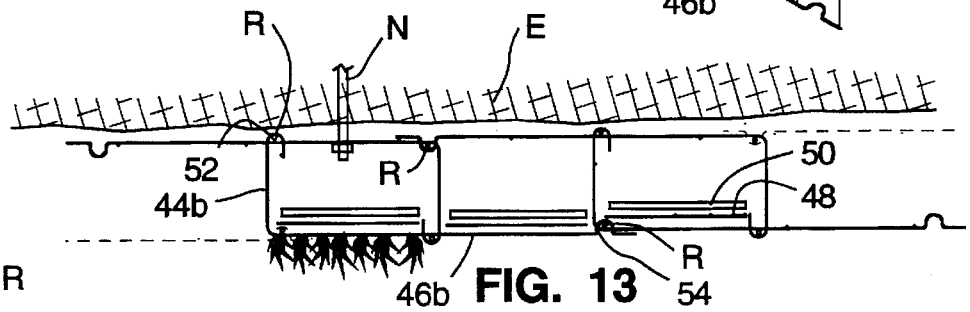
FIG. 13 is a top plan view of the third embodiment wall of FIG. 12, as the wall would appear when secured to the face of an earthen formation.
Figure 14:
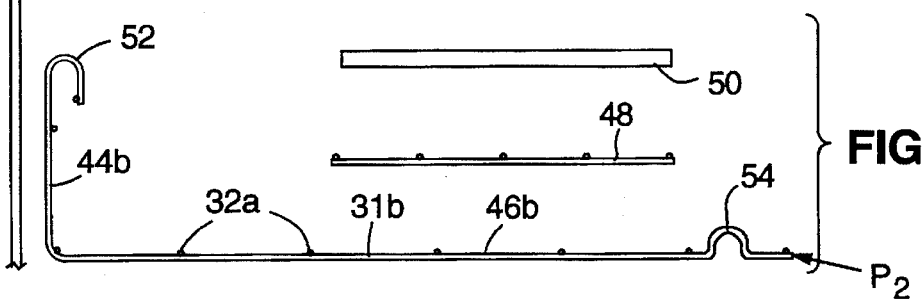
FIG. 14 is an exploded top plan view of a portion of the third embodiment wall, illustrating the components which are repeated in the construction of the wall.

The third embodiment wall of FIGS. 12–14 is similar to the second embodiment wall in that it embodies angle-shaped panels "$P_2$" of a generally L-shaped configuration, typically having a six by twelve inch wire spacing. The cross-wires of the panels "$P_2$" are designated 31*b* and the vertically extending wires are designated 32*b*. The shorter transversely extending segments of the panels "$P_2$" are designated 44*b* and the longitudinally extending segments are designated 46*b*. The distal ends of the wires 31*b* of the segments 44*b* are folded over to form loops 52. Adjacent to the distal end of the segment 46*b* the wires 31*b* have inwardly kinked portions 54.

As can be seen from the assembled condition of the wall shown in FIG. 13, the angle-shaped panels are disposed in generally oppositely extending overlapping condition to form the wall. In this condition, the loops 52 of one panel extend through an intermediate portion of the longitudinal segment of an adjacent panel and the kinked portions 54 extend through the intersecting segments of the next adjacent panel. The panels are held in such orientation by rods "R." The rods "R" engaged through the loops 52 extend to the outside of the segment 46*b* through which the loops extend. The rods "R" extending through the kinked portions 54 extend to the inside of the segment 46 therewith.

The panels "$P_2$" are secured to the earthen formation "E" by nails "N" in the same manner as the panels of the second embodiment wall previously described with respect to FIG. 10. When so assembled, backing mats 48 and soil erosion mats 50 are disposed within the wall adjacent its outer surface in generally the same manner as previously described with respect to the second embodiment wall. FIG. 13 shows plant life growing through the outer surface of the wall.

Fourth Embodiment Wall

Figure 15:
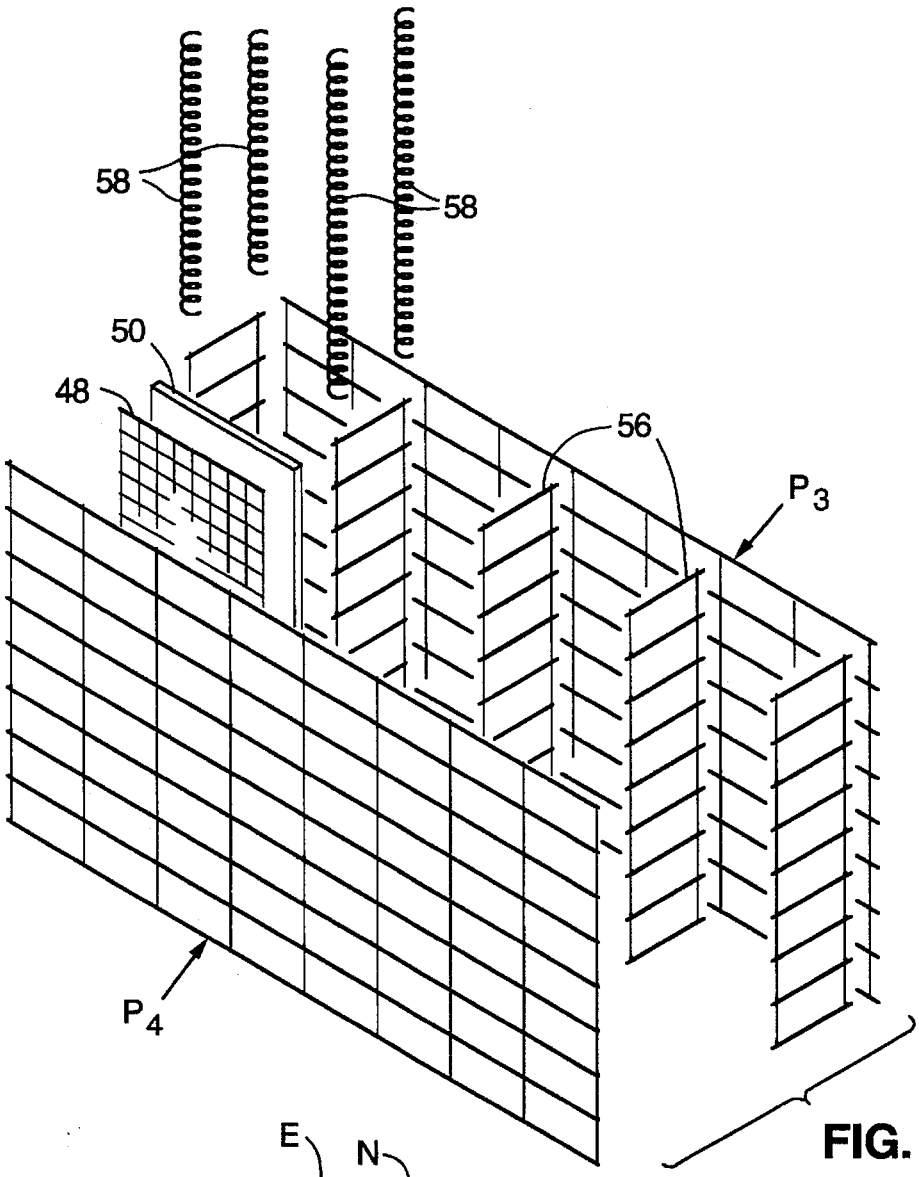
FIG. 15 is an exploded perspective view of a fourth embodiment of the inventive wall.
Figure 16:
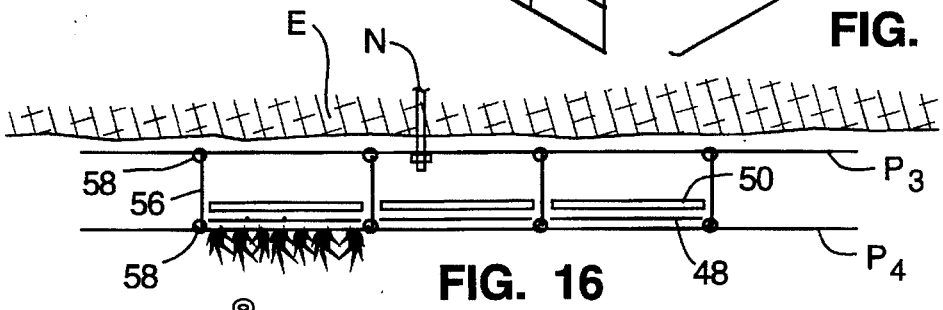
FIG. 16 is a top plan view of the fourth embodiment wall of FIG. 15, as the wall would appear when secured to the face of an earthen formation.
Figure 17:
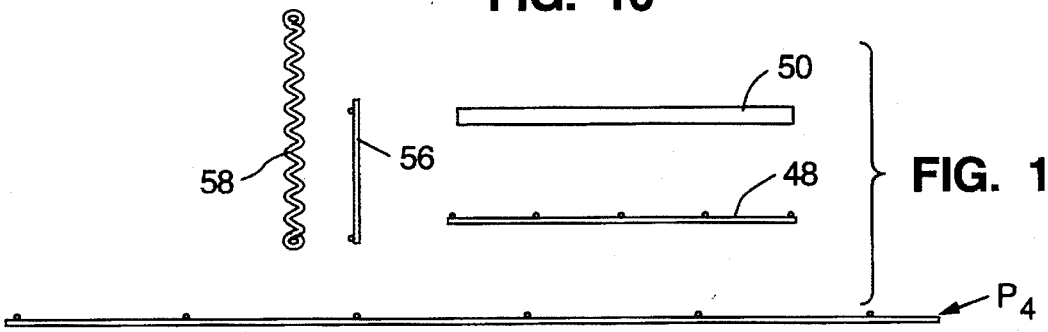
FIG. 17 is an exploded top plan view of a portion of the fourth embodiment wall, illustrating the components which are repeated in the construction of the wall.

This wall is shown in FIGS. 15–17 and comprises identical inner and outer welded wire panels "$P_3$" and "$P_4$"; spanning welded wire gridworks 56; spiral connectors 58; backing mats 48 and soil erosion mats 50. The wires within the gridworks of the mats "$P_3$" and "$P_4$" are typically spaced six inches by twelve inches. The backing mats 48 typically have the same three inch by three inch wire spacing of the previously described backing mats.

In the assembled condition, the inner and outer mats "$P_3$" and "$P_4$" are disposed in spaced parallel relationship with the spanning gridworks 56 extending therebetween. The gridworks 56 are secured to the panels "$P_3$" and "$P_4$" as graphically illustrated in FIG. 15, by spiral connectors 58. Vertically extending wires at the ends of the gridworks 56 are disposed closely adjacent wires of the panels "$P_3$" and "$P_4$" to accommodate the spiral connectors 58. As shown in FIG. 16, the fourth embodiment wall is secured to an earthen formation "E" by nails "N" in a manner corresponding to that previously described with reference to the second embodiment wall. This connection may be achieved, for example, by the hangers of FIGS. 3 or 6. Backing mats 48 and soil erosion mats 50 are disposed to the interior of the outside panel of the second embodiment wall, as may be seen from both FIGS. 15 and 16. Soil is filled into the cavity within the wall. FIG. 16 graphically depicts plant life growing through the outer panel of the wall.

Fifth Embodiment Wall

Figure 18:
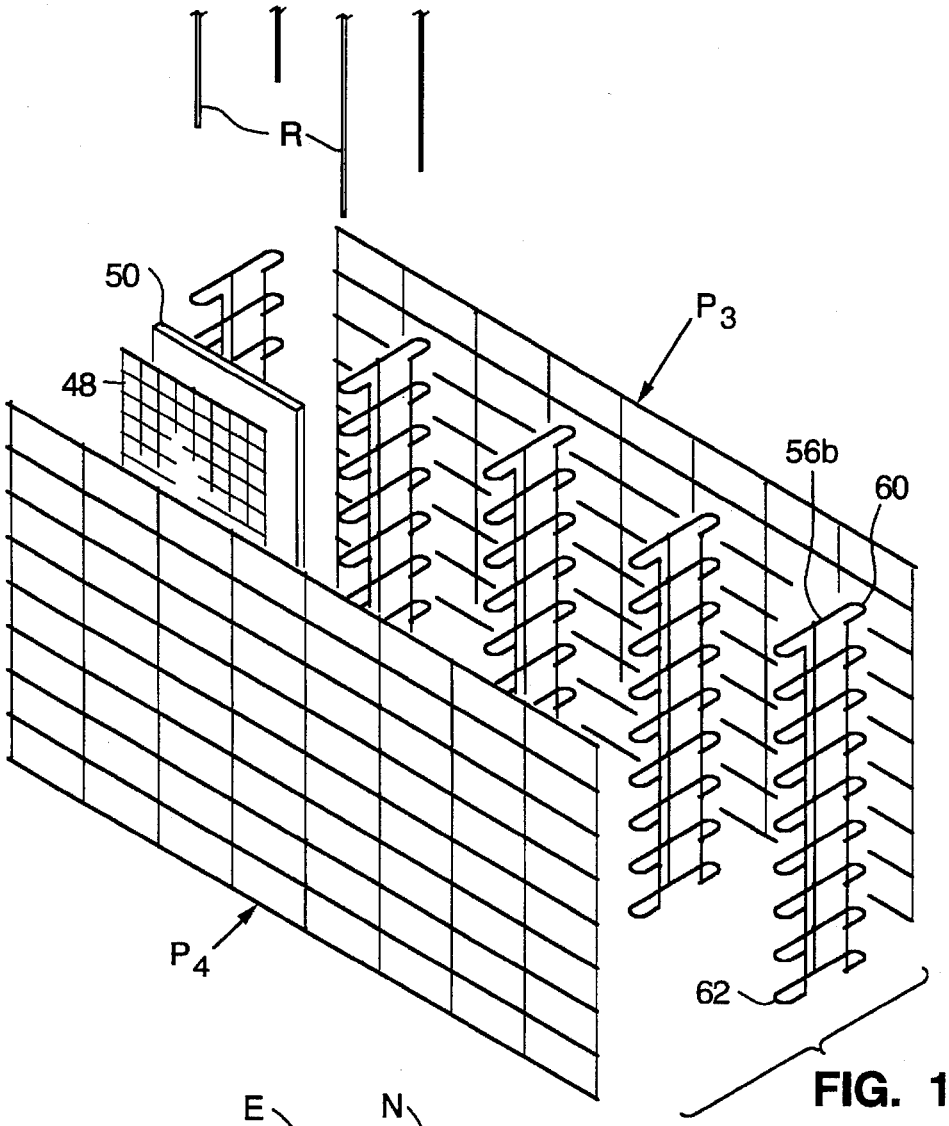
FIG. 18 is an exploded perspective view of a fifth embodiment of the inventive wall.
Figure 19:
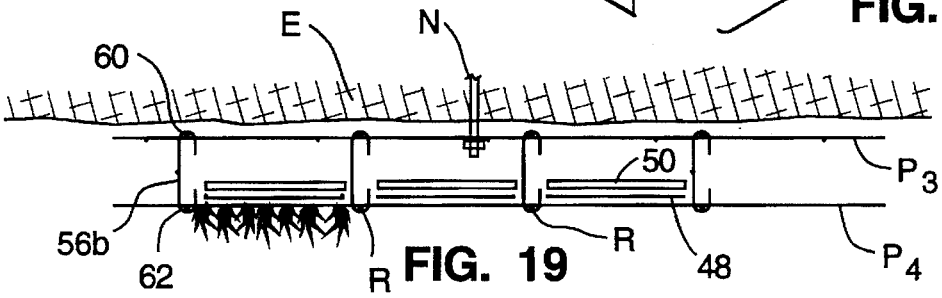
FIG. 19 is a top plan view of the fifth embodiment wall of FIG. 18, as the wall would appear when secured to the face of an earthen formation.
Figure 20:
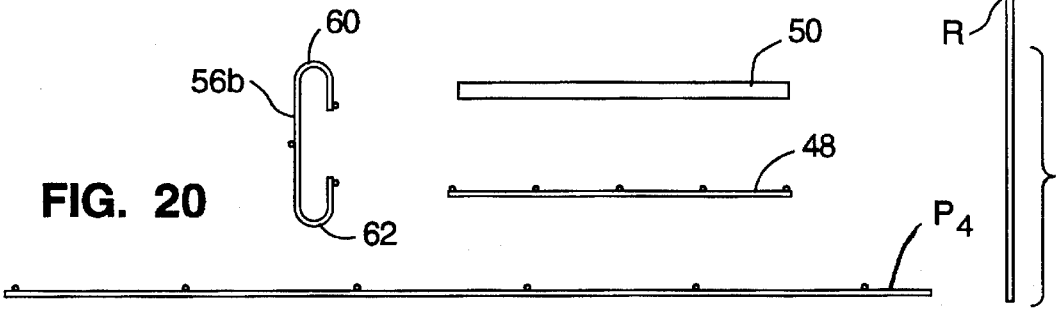
FIG. 20 is an exploded top plan view of a portion of the fifth embodiment wall, illustrating the components which are repeated in the construction of the wall.
Figure 21:
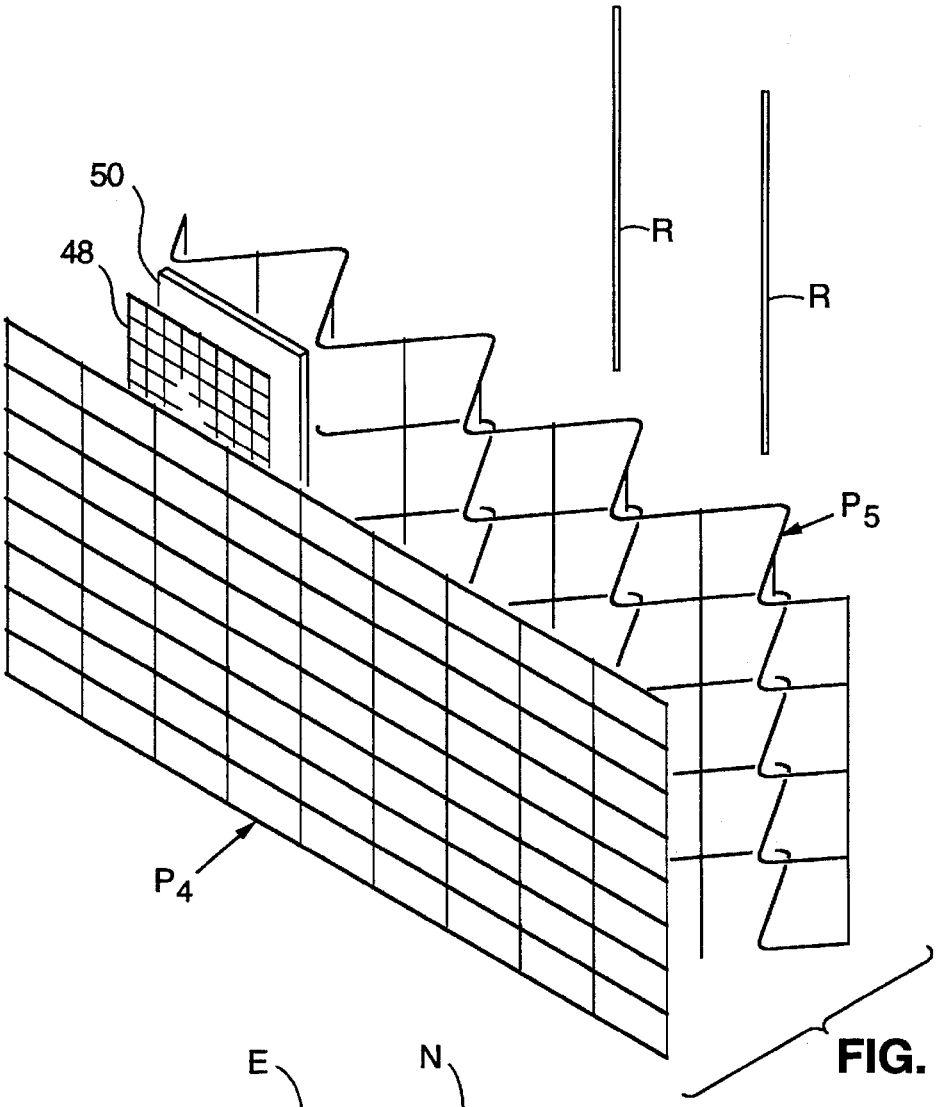
FIG. 21 is an exploded perspective view of a sixth embodiment of the inventive wall.

The fifth embodiment wall shown in FIGS. 18–20 has inner and outer panels "$P_3$" and "$P_4$" corresponding identically to those of the fourth embodiment wall and backing mats 48 and soil erosion mats 50 also corresponding to those of the fourth embodiment wall. The principal difference between the fourth and fifth embodiment walls is that the spanning welded wire gridworks **56*b* of the fifth embodiment wall are formed with inwardly bent inner and outer ends 60 and 62, respectively. When assembled as shown in FIG. 19, these ends extend through the panels and rods "R" extend through the ends to the outside of the panels so as to secure the gridworks 56*b* and tension between the panels. As seen in FIG. 19, nails "N" secure the fifth embodiment wall to the earthen formation "E" similarly to the nails "N" of the fourth embodiment wall. Also, similar to the latter wall, the backing mats 48 and soil erosion mats 50 are disposed to the interior of the outer panel of the wall. Soil is filled into the cavity between the panels of the wall. FIG. 19** graphically depicts plant life growing through the outer panel of the wall.

Sixth Embodiment Wall

Figure 22:
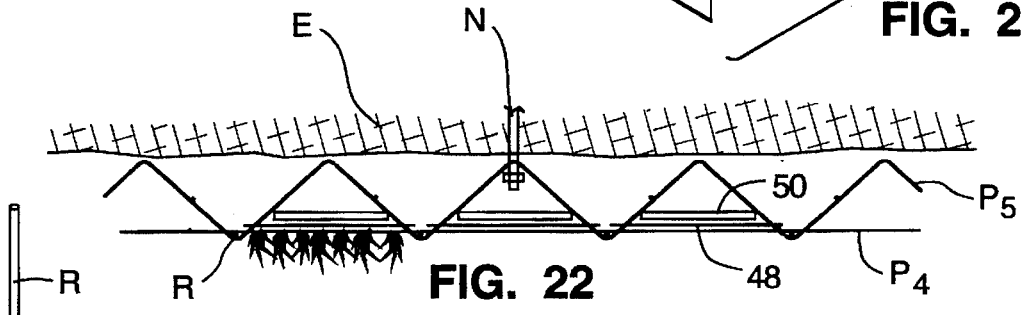
FIG. 22 is a top plan view of the sixth embodiment wall of FIG. 9, as the wall would appear when secured to the face of an earthen formation.
Figure 23:
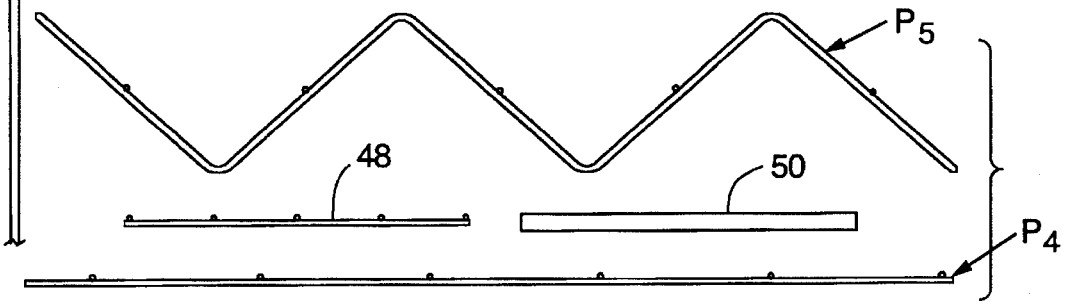
FIG. 23 is an exploded top plan view of a portion of the sixth embodiment wall, illustrating the components which are repeated in construction of the wall.
Figure 24:
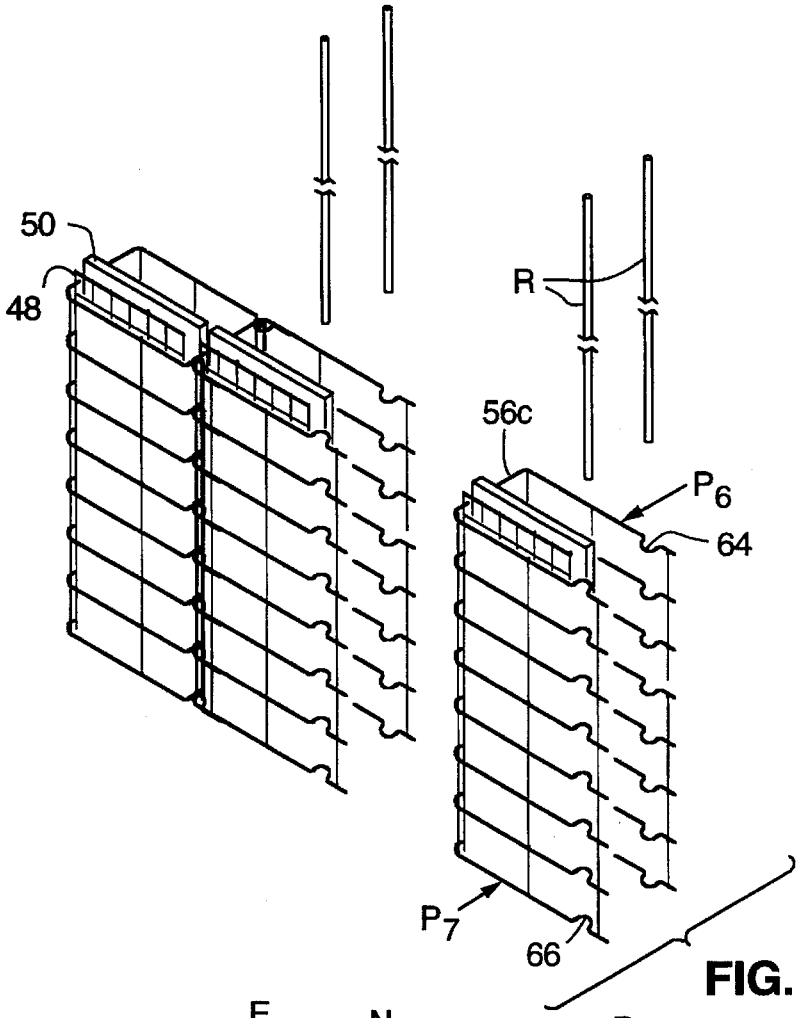
FIG. 24 is an exploded perspective view of a seventh embodiment of the inventive wall.

This wall comprises a planar outer panel "$P_4$" of generally the same construction as the walls of the fourth and fifth embodiments and an inner panel "$P_5$" of a zig-zag configuration, as viewed in plan. In the assembled condition, as shown in FIG. 22, the outer extremities of the inner panel extend through the outer panel and rods "R" extend through these outer extremities to secure the panels together. The inner extremities of the inner panel are secured to the earthen formation "E" by soil nails "N." For the latter purpose, hangers such as those shown in FIGS. 3 or 6 may be used.

In the fully assembled condition, backing mats 48 and soil erosion mats 50 are disposed to the inside of the outer panel "$P_4$" and soil is filled into the space between the inner and outer panels. Additionally, soil is filled into the space between the earthen formation "E" and the inside of the inner panel, as viewed in FIG. 22. FIG. 22 also illustrates plant life growing through the outer panel "$P_4$."

The spacing of the wires within the inner and outer panels "$P_4$" and "$P_5$" of the sixth embodiment can be substantially the same as that of the fourth and fifth embodiments. Similarly, the spacing of the wires within the backing mats 48 can be similar to those of the latter embodiments.

Seventh Embodiment Wall

Figure 25:
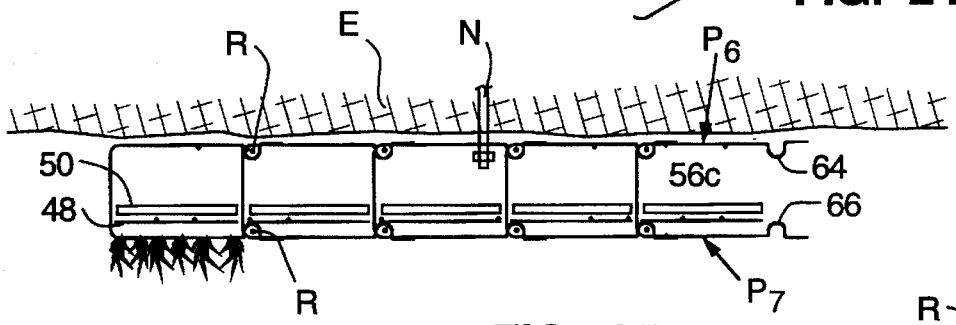
FIG. 25 is a top plan view of the seventh embodiment wall of FIG. 24, as the wall would appear when secured to the face of an earthen formation.
Figure 26:
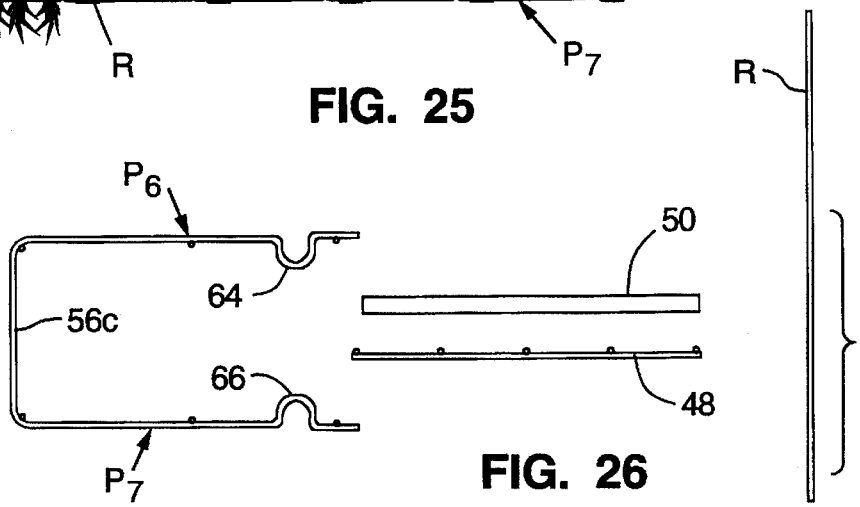
FIG. 26 is an exploded top plan view of the seventh embodiment wall, illustrating the components which are repeated in the construction of the wall.
Figure 27:
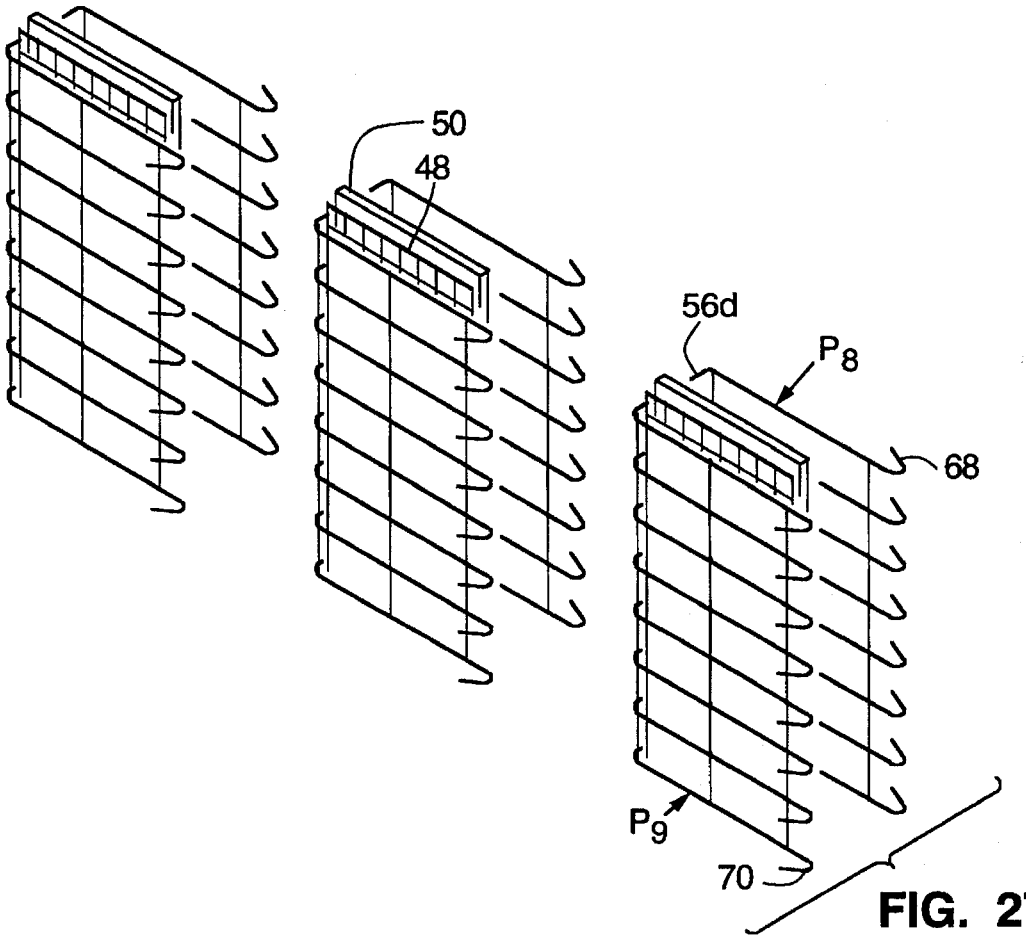
FIG. 27 is an exploded perspective view of an eighth embodiment of the inventive wall.

The inner and outer panels of this wall are comprised of generally U-shaped segments of welded wire gridwork, as viewed in plan (see FIGS. 25 and 26). The segments are identical to one another and each comprise: an inner panel "$P_6$"; an outer panel "$P_7$"; a spanning bight portion **56*c*; and, inwardly kinked portions 64 and 66, respectively, formed adjacent the distal ends of the panels "$P_6$" and "$P_7$." In the assembled condition shown in FIG. 25, the segments of the wall are vertically disposed with the kinked portions 64 and 66 of one segment extending through the panels "$P_6$" and "$P_7$" of the next adjacent segment proximal to the bight portion 56*c* of the latter segment. Rods "R" are then extended through the inwardly kinked portions 64 and 66 to the interior of the panels "$P_6$" and "$P_7$" to secure the segments of the wall together. As so secured, the bight portions 56*c* maintain the inner and outer wall panels in spaced relationship. Backing mats 48 and soil erosion mats 50** are disposed within the wall to the inside of the outer panels "$P_7$." Soil is filled into the void of the wall between the inner and outer panel.

As shown in FIG. 25, the seventh embodiment wall is secured to an earthen formation "E" through nails "N." The connection between the nails and the wall may be through hanger plates, such as those shown in FIGS. 3 and 6.

Eighth Embodiment Wall

This wall is similar to that of the seventh embodiment in that it is made up of generally U-shaped welded wire segments secured together in vertically disposed side-by-side relationship. Each segment comprises an inner panel "$P_8$" and an outer panel "$P_9$" spanned by an integral welded wire gridwork **56*d* which forms a bight portion between the inner and outer panels. The cross-wires of the segments are designated 31*d* and the vertically extending wires of the segments are designated 32*d*. Wires 32*d* extend vertically at the corners formed between the bight portion defined by the gridworks 56*d* and the panels "$P_8$" and "$P_9$." The wires 31*d* at the distal ends of the panels "$P_9$" and "$P_8$" are bent back to form hooks 68 and 70**.

Figure 28:
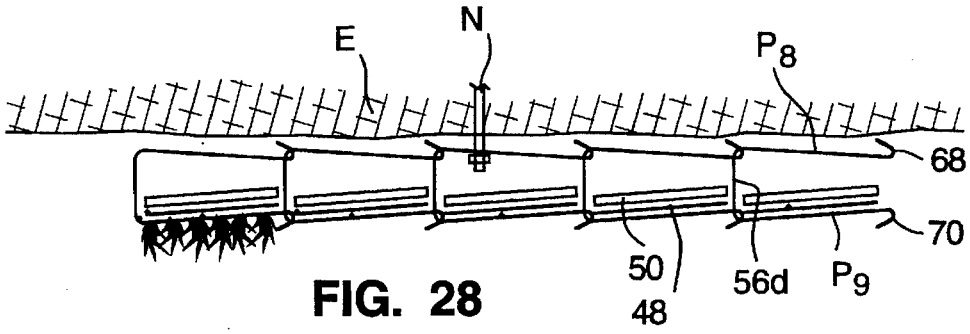
FIG. 28 is top plan view of the eighth embodiment wall of FIG. 27, as the wall would appear when secured to the face of an earthen formation.
Figure 29:
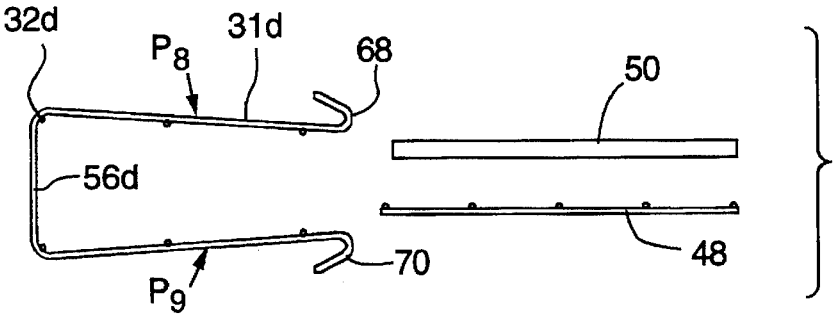
FIG. 29 is a exploded top plan view of a portion of the eighth embodiment wall, illustrating the components which are repeated in the construction of the wall.

In the assembled condition shown in FIG. 28, the hooks 68 and 70 of one segment hook around the vertically extending wires **32*d* of the next adjacent segment at the intersection of the gridwork 56*d* and the panels "$P_8$" and "$P_9$." The composite wall is secured to the earthen formation "E" by nails "N," similarly to the wall of the seventh embodiment. Backing mats 48 and soil erosion mats 50 are disposed within the wall adjacent the outer panels "$P_9$." The cavity within the wall between the inner and outer panels is filled with soil as the wall is erected. FIG. 28** shows plant life growing on the outer panel.

Ninth Embodiment Wall

This wall is fabricated of U-shaped segments corresponding to those of the eighth embodiment wall. These segments comprise: inner and outer panels "$P_8$" and "$P_9$"; spanning gridworks **56*d* between the inner and outer panels; wires 31*d* and 32*d*; and, hooks 68 and 70**.

Figure 30:
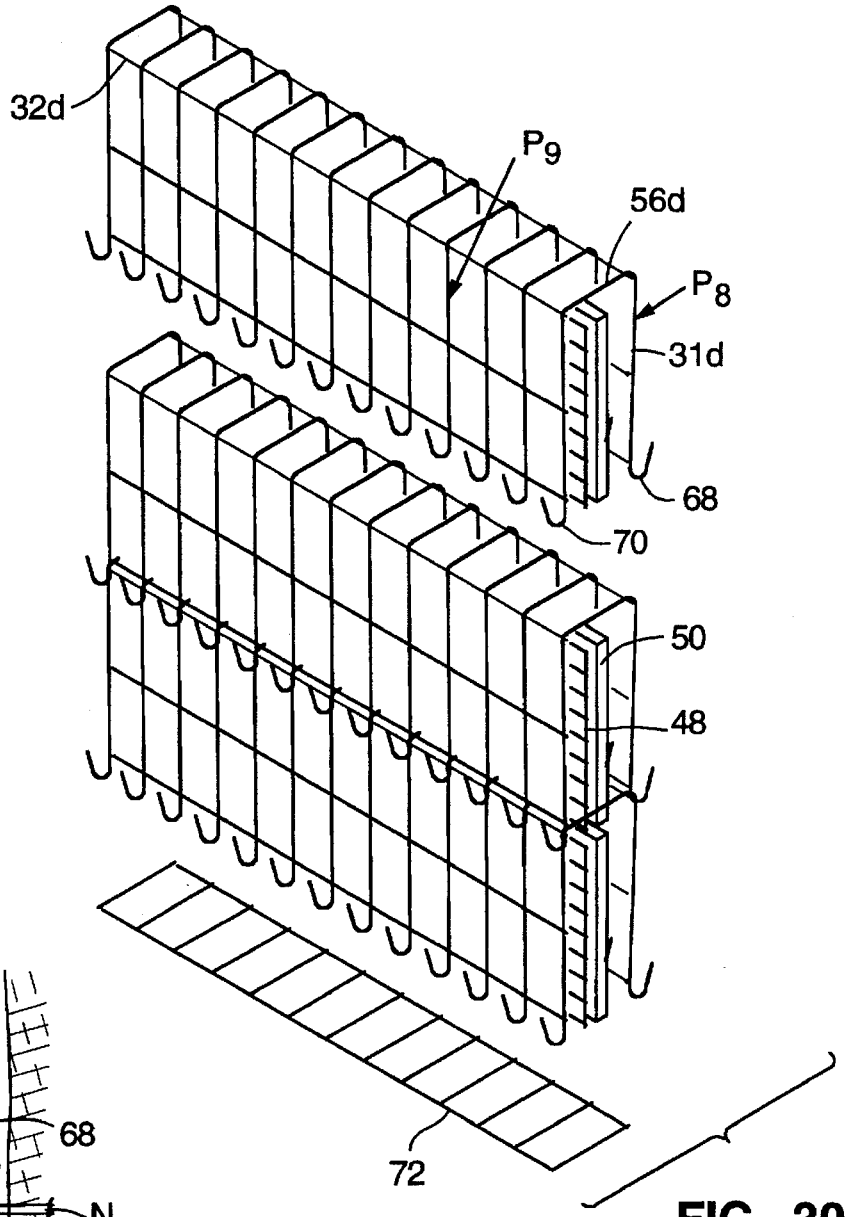
FIG. 30 is a perspective view of a ninth embodiment of the inventive wall, with the bottom and top portions of the wall exploded to illustrate its components.
Figure 31:
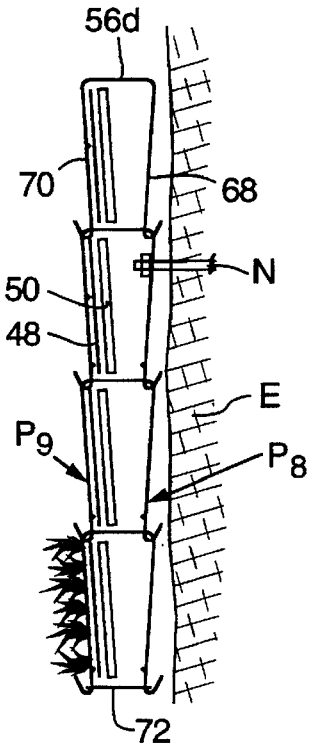
FIG. 31 is a side elevational view of the ninth embodiment wall of FIG. 30, as the wall would appear when secured to the face of an earthen formation.
Figure 32:
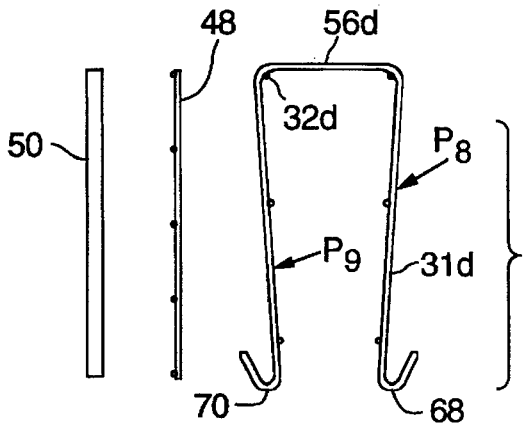
FIG. 32 is an exploded side elevational view of a portion of the ninth embodiment wall, illustrating the components which are repeated in the construction of the wall.

In the assembled condition, the ninth embodiment wall differs from that of the eighth embodiment wall in that the segments extend horizontally in stacked relationship, rather than side-by-side. The interconnected relationship may be seen from FIGS. 30 and 31. As so disposed, the wires **31*d* extend across the wall and the wires 32*d* extend vertically. FIGS. 30 and 31 also show a separate welded wire gridwork 72 engaged over the hooks 68 and 70 of the lowermost segment to secure the panels "$P_8$" and "$P_9$" of that segment against separation. As shown in FIG. 31, the wall is secured to an earthen formation "E" by nails "N" and backing and soil erosion mats 48 and 50, respectively, are disposed within the wall. The wall may be secured to the nails "N" by hanger plates of the types shown in FIGS. 3 and 6. Soil would be filled into the cavity between the inner and outer panels "$P_8$" and "$P_9$." FIG. 31** depicts plant life growing from the lowermost segment of the wall.

Tenth Embodiment Wall

This wall, like that of the ninth embodiment, is also made up of welded wire segments which extend horizontally in a stacked or hanging relationship relative to one another. In the tenth embodiment wall, however, the segments are made up of intersecting panels, designated "$P_{10}$" and "$P_{11}$," respectively. The panels "$P_{10}$" and "$P_{11}$" diverge and are spanned at their upper ends by a bridging gridwork 74 formed integrally with the inner panel "$P_{10}$." The distal end of the gridwork 74 is bent back upon itself and hooks over one of the wires **32*e* of the panel "$P_{11}$." The cross-wires of the gridwork wires making up the panels "$P_{10}$" and "$P_{11}$" are designated 31*e***.

Figure 33:
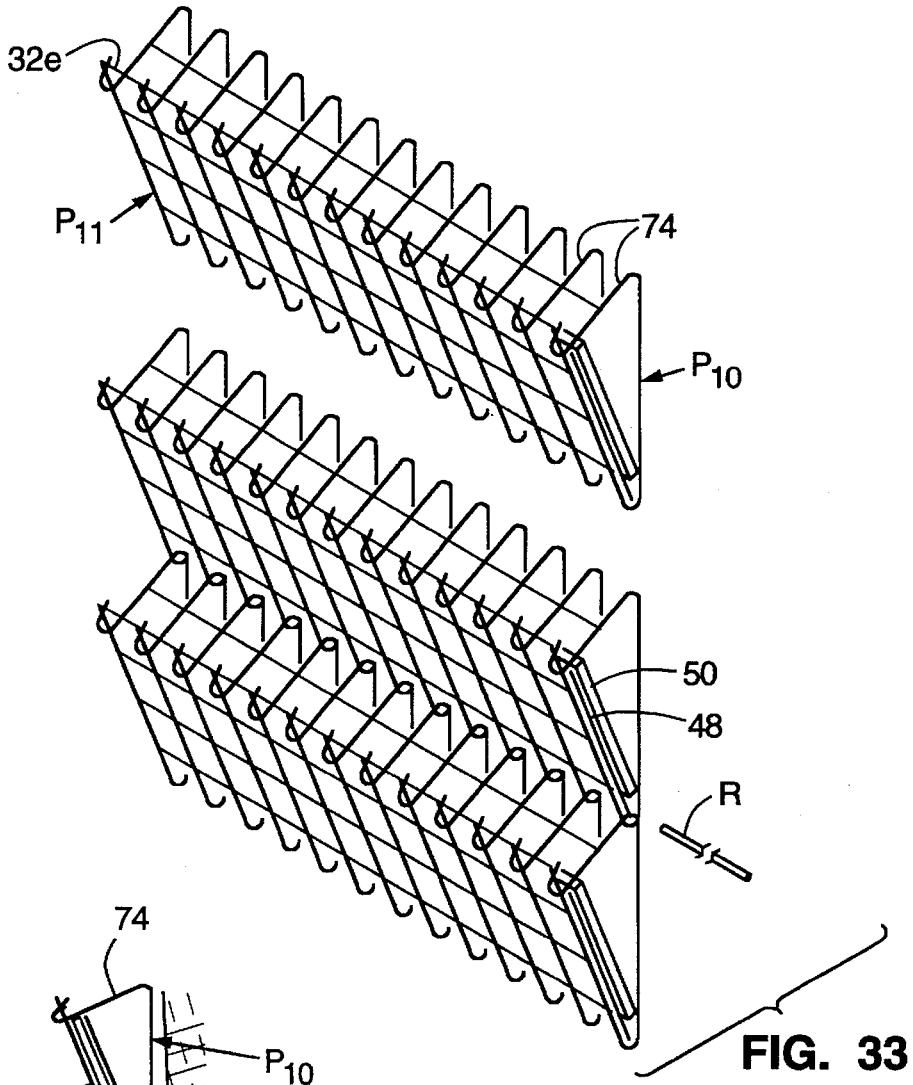
FIG. 33 is a perspective view of a tenth embodiment of the inventive wall, with the upper portion of the wall exploded to illustrate its construction.
Figure 34:
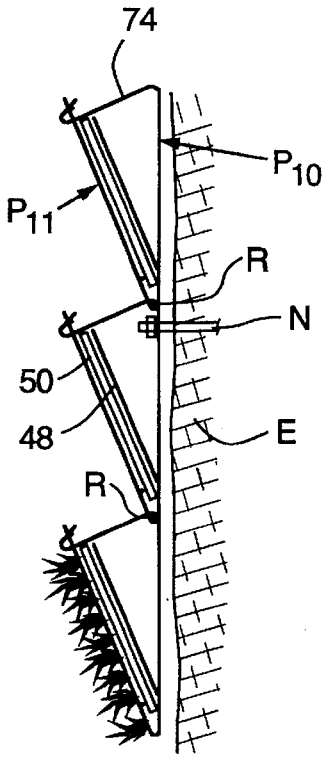
FIG. 34 is a side elevational view of the tenth embodiment wall of FIG. 33, as the wall would appear when secured to the face of an earthen formation.
Figure 35:
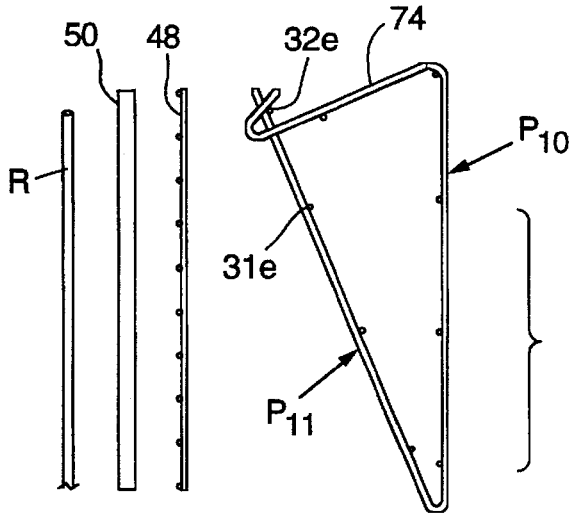
FIG. 35 is an exploded side elevational view of a portion of the tenth embodiment wall, illustrating the components which are repeated in the construction of the wall.

In the assembled condition, the segments of the tenth embodiment wall are disposed so that the apex defined between the lowermost ends of the panels "$P_{10}$" and "$P_{11}$" extends between and beneath the bridging gridworks of the segment thereunder. A rod "R" is then extended over the apex of the intersecting panels and beneath the bridging gridwork 74 to secure the segments together. This relationship may be seen in FIGS. 33 and 34. As seen in the latter figure, the assembled wall is secured to an earthen formation "E" by nails "N." The wall may be secured to the nails "N"

by hanger plates of the type shown in FIGS. 3 or 6. Backing mats 48 and soil erosion mats 50 are disposed within the wall behind the outer panel "$P_{11}$" and the cavity defined between the panels is filled with soil. FIG. 34 illustrates plant life growing on the lowermost segment of the wall.

Eleventh Embodiment Wall

The eleventh embodiment wall corresponds in construction to the fourth embodiment wall in that it is comprised of inner and outer panels "$P_3$" and "$P_4$," respectively, connected by spanning welded wire gridworks 56 secured thereto by spiral connectors 58. It differs from the fourth embodiment wall primarily in that it is free-standing (i.e., it is not secured to the face of an earthen formation).

Figure 36:
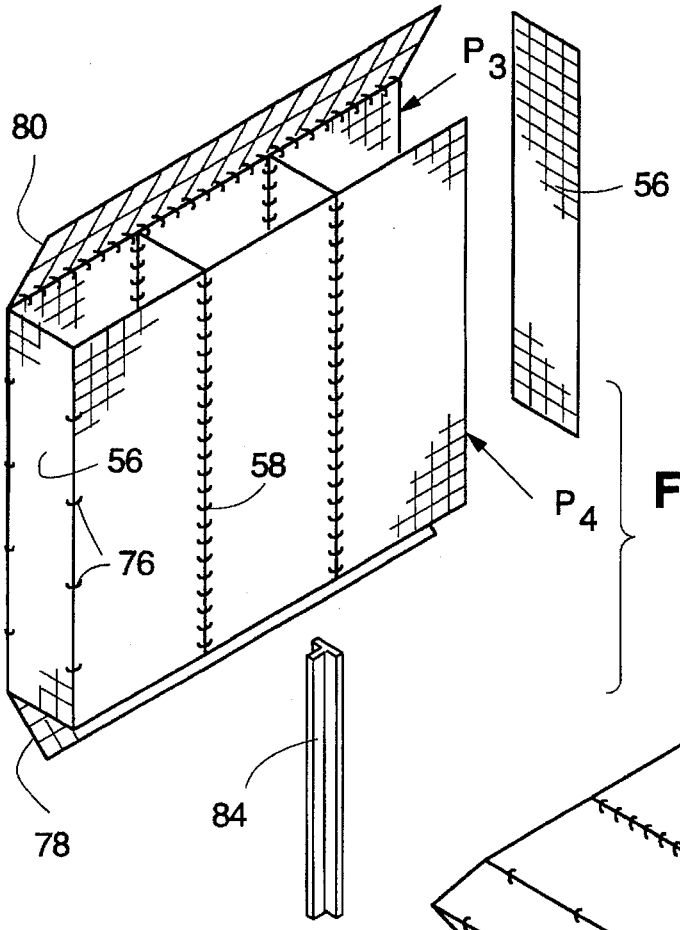
FIG. 36 is a perspective view of an eleventh embodiment of the inventive wall, with parts thereof shown exploded to illustrate the construction of the wall, and a post which may be used to make the wall free-standing.

FIG. 36 shows a segment of wall constructed according to the tenth embodiment. As there shown, the ends of the wall are covered by spanning welded wire gridworks 56 secured thereto by hog rings 76. This wall is also shown with a bottom panel 78 and a top panel 80. The latter panels would be fabricated of welded wire gridworks similar to that of the spanning gridworks 56. They are hingedly secured to the inner panel "$P_3$" by spiral binders 82.

Figure 36A:
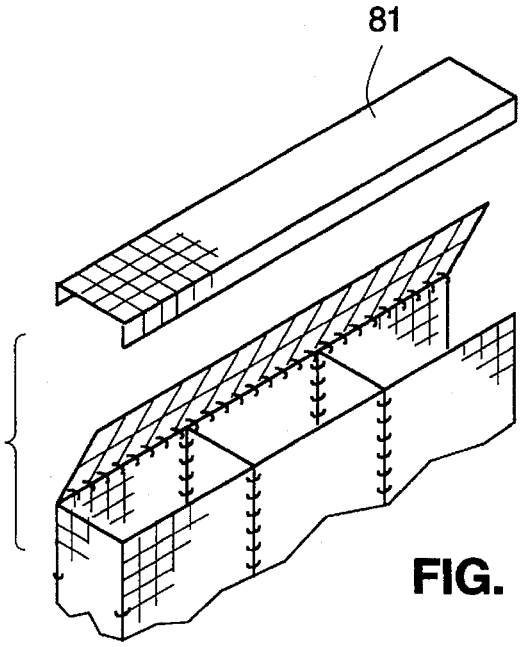
FIG. 36A is a perspective view of an optional cap which may be used on the eleventh embodiment wall of FIG. 36.

When the top and bottom panels 78 and 80 are closed, they may be held in the closed condition by hog rings. As an alternative to the hinged top panel 80, an optional separate cap 81, as shown in FIG. 36A, may be used.

Figure 37:
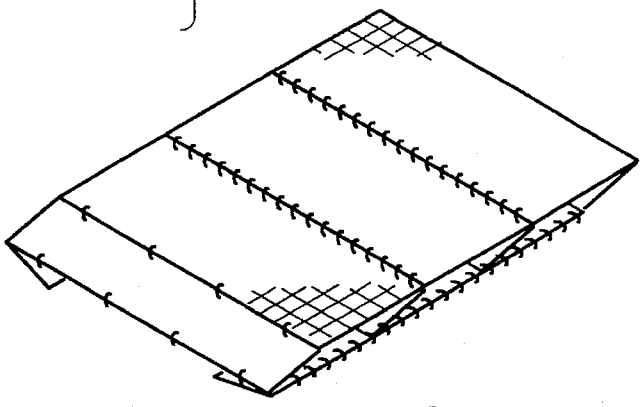
FIG. 37 is a perspective view of the components of the eleventh embodiment wall of FIG. 36, as the components would appear when assembled and folded into flat condition for shipment.

FIG. 37 shows the eleventh embodiment wall folded flat for shipment. Thus folding the wall is accommodated by the spiral binders and hog rings which secure the spanning welded wire gridworks 56 between the panels "$P_1$" and "$P_2$." As there shown, the bottom panel 78 is folded up against the inner panel "$P_3$."

Figure 38:
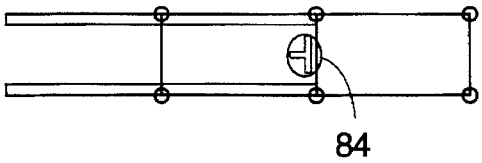
FIG. 38 is a top plan view of the eleventh embodiment wall of FIG. 36, as the wall would appear when supported in free-standing relationship by a post.

FIG. 38 shows a generally T-shaped post 84 within the tenth embodiment wall. Such a post would be anchored in the earth and secured to the spanning welded wire gridworks 56.

Figure 39:
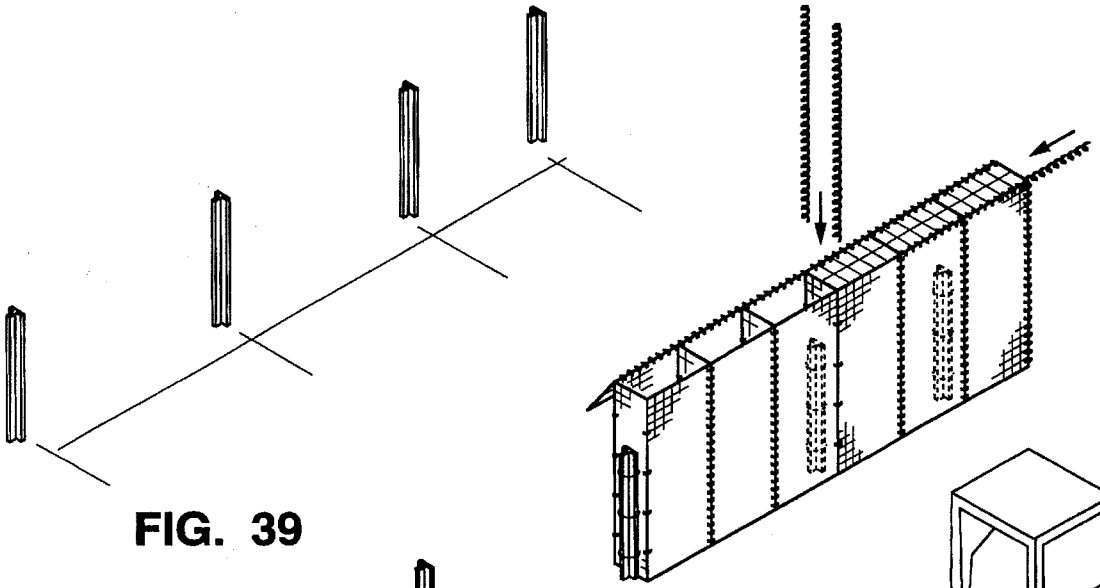
FIG. 39 is a perspective view showing a typical pattern of posts arranged to support the eleventh embodiment wall.

FIG. 39 shows how the posts to support the tenth embodiment wall might be anchored in the earth in spaced relationship. These would be typically at six foot centers over the mid-portion of the wall and four foot centers at the ends of the wall.

Figure 40:
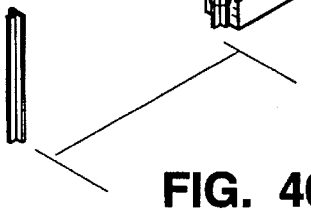
FIG. 40 is a perspective view of the eleventh embodiment wall of FIG. 36, illustrating the wall supported in free-standing relationship by posts, with the spiral connectors shown partially exploded and removed to illustrate the manner in which the wall is assembled; and, FIG. 41 is a perspective view of the eleventh embodiment wall of FIG. 36, illustrating the wall supported in free-standing relationship in the process of being filled with soil.

FIG. 40 shows the wall secured to the posts and the manner in which spiral binders can be used to secure successive segments of the wall together.

Figure 41:
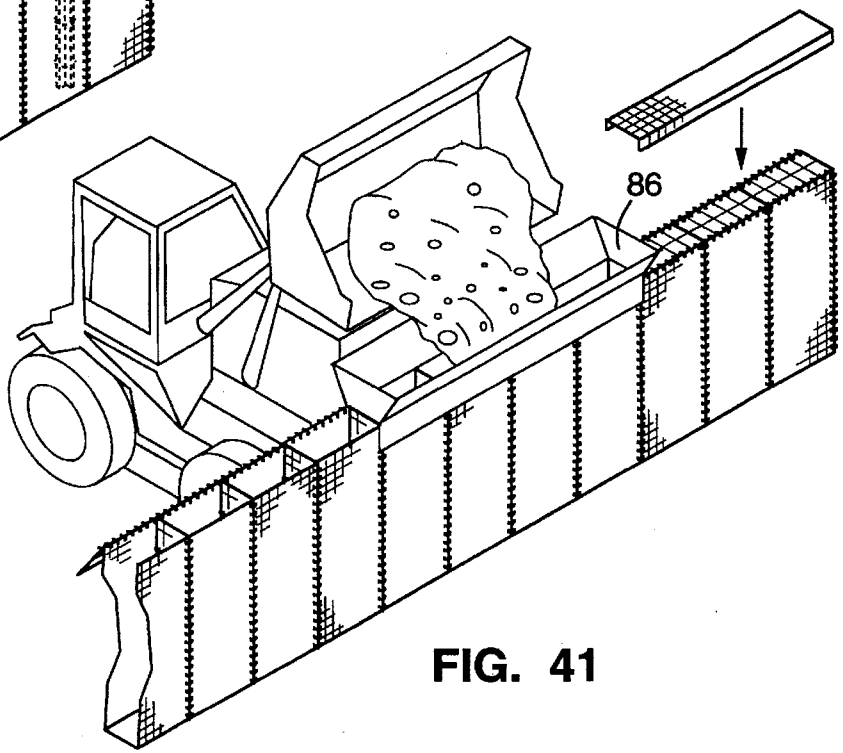

FIG. 41 shows an erected wall in the process of being filled with soil. As there shown, a funnel attachment 86 is disposed over the top of the wall and a loader is dumping into the wall through this attachment. FIG. 41 also shows the optional cap of FIG. 36A.

Although not shown in all figures, it should be understood that the eleventh embodiment wall would be provided with internal soil erosion mats and backing mats on both sides. This may be seen from FIG. 38. Such mats contain soil within the cavity of the wall and also adapt the outer surface of the wall for the growing of plant life.

Conclusion

While preferred embodiments of the wall have been illustrated and described, it should be understood that the invention is not intended to be limited to the specifics of these embodiments, but rather is defined by the accompanying claims. The key feature of the invention is the provision of a welded wire wall capable of containing soil for the growing of plant life on one or both sides of the wall.

We claim:

1. A method of constructing a free standing anti-graffiti sound barrier wall on a situs where the wall is to be located so as to provide a structure capable of accommodating the growth of plant life, said method comprising:

a. mounting posts to the situs in generally vertically disposed horizontally spaced relationship;

b. disposing a pair of welded wire panels at the situs in a location adjacent said posts in face-to-face generally vertically disposed spaced relationship to one another to define a soil receiving cavity therebetween;

c. securing the panels together and to the posts in said spaced relationship; and, d. progressively filling the cavity between the panels from bottom to top with soil.

2. A method according to claim 1 wherein the panels are disposed to either side of the posts so that the posts are confined within the wall.

3. A method according to claim 1 wherein the panels are secured in spaced relationship by securing welded wire gridworks in spanning relationship between the panels.

4. A method according to claim 3 wherein the posts are disposed between the panels and secured thereto by connection to the spanning gridworks.

5. A method according to claim 3 wherein the spanning gridworks are secured to the panels by spiral ties which wrap around the spanning gridworks and the panels.

6. A method according to claim 3 wherein the spanning gridworks are formed with loops which extend through the panels and the gridworks are secured to the panels by rods which extend through the loops.

7. A method according to claim 3 wherein the spanning gridworks are formed integrally with one of the panels and have free ends secured to the other of the panels.

8. A method according to claim 7 wherein the free ends of the spanning gridworks are formed with hooks which wrap around the other of the panels.

9. A method according to claim 7 wherein the free ends of the spanning gridworks provide loops extending through the other of the panels and rods are extended through said loops to secure the free ends to the other of the panels.

10. A method according to claim 1 wherein:

a. one of the welded wire panels is of a zig-zag configuration and includes a portion extending through the other of the panels; and, b. the panels are secured in spaced relationship by extending a rod through said portion of said one panel.

11. A method according to claim 1 wherein:

a. the panels are comprised of segments having opposed planar portions with free distal ends and proximal ends integrally joined by a bight portion; and, b. the segments are joined to one another so that the free distal ends of one segment are secured to the proximal end of another segment and the opposed planar portions of the panels are secured in spaced relationship by the bight portions.

12. A method according to claim 11 wherein:

a. the free distal ends of the panels are formed with bent portions which extend through the proximal end of the segment joined thereto; and, b. rods are extended through said bent portions to secure the free distal ends of said one segment to the proximal end of said other segment.

13. A method according to claim 11 wherein the free distal ends of the panels are formed with bent portions which are extended through the proximal end of the segment joined thereto and hook around said segment to secure the free distal ends of said one segment to the proximal end of said other segment.

14. A method according to claim 1 further comprising extending a cap over and between the panels after the cavity is filled.

15. A method according to claim 6 wherein the cap is a welded wire gridwork hingedly secured to one of the panels for select extension over the other of the panels.

* * * * *